US007336472B2

(12) United States Patent
Nerheim et al.

(10) Patent No.: US 7,336,472 B2
(45) Date of Patent: Feb. 26, 2008

(54) SYSTEMS AND METHODS FOR ILLUMINATING A SPARK GAP IN AN ELECTRIC DISCHARGE WEAPON

(75) Inventors: Magne H. Nerheim, Paradise Valley, AZ (US); Ryan C. Markle, Peoria, AZ (US); Matthew T. Carver, Phoenix, AZ (US); Nache Shekarri, Phoenix, AZ (US)

(73) Assignee: Taser International, Inc., Scottsdale, AZ (US)

( * ) Notice: Subject to any disclaimer, the term of this patent is extended or adjusted under 35 U.S.C. 154(b) by 0 days.

(21) Appl. No.: 10/957,315

(22) Filed: Sep. 30, 2004

(65) Prior Publication Data

US 2006/0072280 A1 Apr. 6, 2006

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS 3,256,439 A * 6/1966 Dyke et al. ..... 378/102
4,287,548 A 9/1981 Hahndorff
4,755,719 A 7/1988 Limpaecher
5,153,460 A * 10/1992 Bovino et al. ..... 307/108
5,249,095 A 9/1993 Hunter
5,962,806 A * 10/1999 Coakley et al. ..... 102/502
5,995,355 A 11/1999 Daeumer
6,407,382 B1 6/2002 Spangler
6,529,361 B1 3/2003 Petschel et al.

OTHER PUBLICATIONS

Glenn Elert, "Photoelectric Effect," http://hypertextbook.com/physics/modern/photoelectric, Sep. 27, 2004.
Michael Fowler, "Photoelectric Effect," http://www.phys.virginia.edu/classes/252/photoelectric-effect.html , © 1997.
OSRAM Semiconductors GmbH, "LW M67C", Mar. 20, 2006.
EPCOS, "Switching Spark Gap SSG3X-1", Apr. 30, 2002.

* cited by examiner

*Primary Examiner*—Ronald W. Leja
(74) *Attorney, Agent, or Firm*—William R. Bachand

(57) ABSTRACT

An electric discharge weapon includes a high voltage circuit, a control circuit, and a light source. The high voltage circuit includes a spark gap having a breakdown voltage affected by light. A magnitude of an electric discharge of the weapon is related to the breakdown voltage of the spark gap. Under control of the control circuit, the light source emits light to illuminate the spark gap prior to conduction so that the magnitude of the electric discharge is within a desired range.

27 Claims, 3 Drawing Sheets

SYSTEMS AND METHODS FOR ILLUMINATING A SPARK GAP IN AN ELECTRIC DISCHARGE WEAPON

FIELD OF THE INVENTION

Embodiments of the present invention relate to electric discharge weapons and methods of operation.

BACKGROUND OF THE INVENTION

Electric discharge weapons apply an electric discharge to a human or animal target to stun and/or immobilize the target. In a conventional electric discharge weapon projectiles, called probes, may be launched by the weapon toward a target. The probes may be connected to the weapon by wires. When the probes make contact with the target, a high voltage circuit is completed to pass a current through the target. The current typically includes pulses having a magnitude controlled by the breakdown voltage of a spark gap in the high voltage circuit. Generally, the energy of the pulses is just sufficient to overpower the normal electrical signals transmitted over the nervous system of the target. Consequently, the target loses muscle control and is stunned or immobilized without serious injury. Spark gap breakdown voltage has been found to increase in the absence of illumination of the spark gap. Without an improved control for pulse energy, a risk of serious injury to targets cannot be further reduced.

SUMMARY OF THE INVENTION

An electric discharge weapon includes a high voltage circuit, a control circuit, and a light source. The high voltage circuit includes a spark gap having a breakdown voltage affected by light. A magnitude of an electric discharge of the weapon is related to the breakdown voltage of the spark gap. Under control of the control circuit, the light source emits light to illuminate the spark gap prior to conduction so that the magnitude of the electric discharge is within a desired range.

A method of operating an electric discharge circuit, according to various aspects of the present invention, includes illuminating a spark gap prior to providing an electric discharge from the weapon. Illumination may begin after a pre-trigger event, and/or after a trigger event is detected. The method, in other implementations, may further include determining that the spark gap has not conducted during a period and on lapse of the period performing illuminating. Illuminating may be pulsed, for example, to conserve energy or simplify control. Illuminating may be repeated, for example, to decrease peak power consumption.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
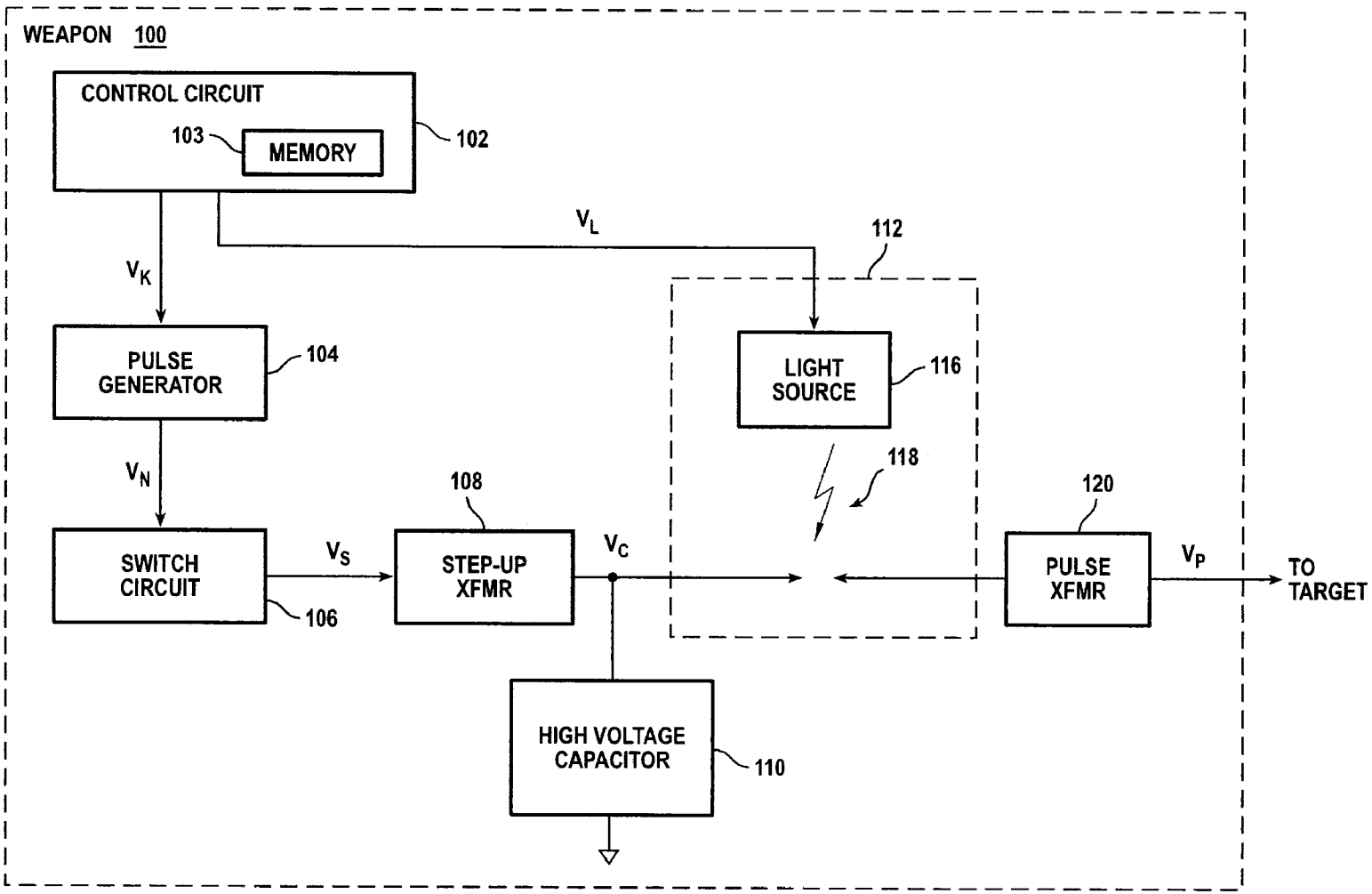
FIG. 1 is a functional block diagram of a weapon according to various aspects of the present invention.

Electric discharge weapons include hand held stun devices held against a target, hand held guns that launch wire tethered probes to a target, firearms that propel an electrified projectile to a target, and stationary devices that implement these weapon technologies (e.g., land mines). Electric discharge weapons include conventional firearms having, in addition to conventional projectiles (e.g., bullets, gas, liquid, powder), a capability of conducting an electric discharge through a target.

In a conventional electric discharge weapon, the target is included in an electrical circuit so that a current conducts through the target. The current is conventionally pulsed to avoid serious injury (e.g., burns). The repetition rate of the pulses is conventionally selected to avoid serious injury (e.g., cardiac arrest). Consequently, control of the amount of energy delivered to the target over time is dependent on the magnitude of each pulse of the current. For simplicity of generation and control, a conventional electric discharge weapon includes a high voltage circuit that charges a high voltage capacitor until a limit voltage is reached, whereupon a pulse is delivered from the weapon to the target and charging restarts. Although a semiconductor high voltage switch may be used to conduct the discharge of the high voltage capacitor, reliable operation has been conventionally achieved with a spark gap at less expense.

An improved electric discharge weapon, according to various aspects of the present invention includes an illuminated spark gap having a characteristic that accurately determines the magnitude of a pulse output of the weapon. For example, weapon 100 of FIG. 1 includes control circuit 102, pulse generator 104, switch circuit 106, step-up transformer 108, high voltage capacitor 110, illuminated spark gap 112, and pulse transformer 120. Weapon 100 may be implemented as any weapon discussed above (e.g., stun stick, gun, electrified projectile, land mine) with additional application specific structures (not shown) and conventional technologies (e.g., stun terminals, wire tethered probes, pyrotechnic launch subsystems, probe deployment mechanisms). For convenience of description, an implementation of weapon 100 as a hand held gun that launches tethered probes to a target will be presumed in the discussion that follows.

A control circuit prepares the weapon for use and enables its electric discharge functions. For example, control circuit 102 may monitor battery power and environmental criteria suitable for operation of weapon 100, monitor a user interface (e.g., safety switch, trigger switch) support displays (e.g., LED indicators of weapon status, alphanumeric display of weapon status, configuration, exceptional conditions, and instructions for use), control use of battery power, and enable and disable generation of output signals of the weapon. Conventional circuitry may be used to implement these functions, such as analog logic and timing circuitry and one or more digital circuits (e.g., a controller or processor) with software stored in conventional memory having instructions for performing methods to accomplish these functions. Control circuit 102 provides signal $V_K$ to enable generation of weapon output signal $V_P$, and signal $V_L$ for operation of illuminated spark gap 112. Operation may proceed as discussed below with reference to FIG. 2.

Any conventional pulse generator, switch circuit, step-up transformer, high voltage capacitor, and pulse transformer may be used with control circuit 102 and illuminated spark gap 112. For example structures and functions may be implemented in weapon 100 of the type described in pending U.S. patent application Ser. No. 10/949,828, entitled "Systems And Methods For Signal Generation Using Limited Power" by Magne Nerheim, filed Sep. 24, 2004, incorporated herein by reference. In other implementations, weapon 100 includes an illuminated spark gap in place of any spark gap used for any purpose in known electric discharge weapon circuitry.

An illuminated spark gap includes a light source and a spark gap. The light source provides light to illuminate the operative elements of the spark gap. Operative elements may include an enclosure (e.g., transparent, or translucent), electrodes within the enclosure, a gas within the enclosure for conducting a current between the electrodes, and suitable light focusing, reflecting, or refracting mechanisms. Implementations of illuminated spark gap 112 may include a gas consisting of air or any conventional gas for predictable breakdown voltage of the gap. For example, implementations may include a gas comprising argon, oxygen, sulfur, and/or fluorine such as $SF_6$). The brightness of light source 116 and proximity to gap 118 are selected according to the application to accomplish reliable breakdown of the gap with expected operating voltages across the gap and following absence of light (e.g., no ambient light or light from source 116) for a maximum expected period of time. Spark gap 118 and light source 116 are preferably in close proximity, however, distance may be compensated for by brighter illumination from light source 116. Illuminated spark gap 112 may be packaged as a unit for suitable pick and place assembly of circuits of weapon 100 with light source 116 internal to the enclosure surrounding electrodes of gap 118. Other implementations have light source 116 external to the enclosure. Illuminated spark gap 112 may be implemented with discrete components.

For example, spark gap 118 may be a generally transparent, argon filled enclosure (e.g., of the type marketed by Epcos, Inc. as model SSG2X-1). Light source 116 may be an LED that provides predominantly white visible light (e.g., of the type marketed by Osram, Inc. as model M67C). For example, the above identified models of spark gap and LED may be used with about a 6 VDC supply in series with the LED and about a 1 Kohm resistor to ground with the enclosures of the LED and spark gap touching or up to about 10 millimeters apart. The LED may be operated for about 50 milliseconds prior to conduction by the gap resulting from a waveform across the gap of the type discussed below with reference to FIG. 2. Another implementation uses a similar spark gap, LED, and separation, where the LED passes about 1 milliamp DC for about 200 milliseconds prior to conduction by gap 118.

An increase in the breakdown voltage of gap 118 leading to unsatisfactory operation of weapon 100 may result from absence of light on gap 118 for about 12 hours or more (e.g., more than 24 hours). Satisfactory operation (as discussed with reference to FIG. 2) is restored by illuminating gap 118 with a white light source 116 as discussed above. The amount of time between illumination and conduction by gap 118 may be over about 12 hours depending on design margins and target safety margins for weapon 100. Conduction during or immediately after illumination is preferred. Functionally equivalent illumination scenarios are discussed below.

Operation of weapon 100, according to various aspects of the present invention, may include illumination of a spark gap prior to conduction by the spark gap. Timing of the beginning and discontinuing of illumination may be understood relative to other operating signals of the weapon. For example, operation of weapon 100 may include signals $V_K$, $V_S$, $V_C$, and $V_P$ of FIG. 2. Positive logic and polarity is shown; other implementations include any mix of positive and negative logic and polarity.

Signal $V_K$ is provided by control circuit 102 to enable (after time T204) operation of pulse generator 104. Pulse generator 104 provides (after time T204) a conventional switching signal $V_N$ to switch circuit 106 (e.g., a semiconductor switch). In the absence of signal $V_K$, pulse generator 104 discontinues provision of switching signal $V_N$. Illumination may begin in response to or in accordance with assertion of signal $V_K$. Illumination may continue as long as signal $V_K$ is asserted (e.g., for a duration of from about 3 to about 10 seconds, preferably about 5 seconds as a series of pulses $V_P$ is provided).

Switch 106 passes a current through the primary of step-up transformer 108. The voltage across the primary of step-up transformer 108 may be expressed as signal $V_S$ comprising a series of relatively short pulses (after time T204). Illumination may be provided in response to or in accordance with one or more pulses of signals $V_N$ or $V_S$.

Signal $V_C$ is a voltage across high voltage capacitor 110; and, increases with rectified current provided by a secondary winding of step-up transformer 108 responsive to signal $V_S$. When a magnitude of signal $V_C$ exceeds (at time T206) a breakdown voltage of gap 118, high voltage capacitor 110 provides current (from time T206 to time T208) to a primary of provided in response to or in accordance with signal $V_C$ (e.g., from time T204 to time T206) prior to the first conduction of gap 118. Signal $V_C$ approaches the breakdown voltage of gap 118 in an exponential manner. In an implementation where expected breakdown voltage is 2000 volts +/−10%, dark storage may result in a first conduction breakdown voltage of more than 2500 volts (e.g., up to 3000 volts after 24 hours dark storage).

Signal $V_P$ is provided (e.g., from time T206 to time T208) by a secondary of pulse transformer 120. After gap 118 ceases conduction (at time T208) the cycle (from time T204 to time T208) repeats at a conventional pulse repetition rate (e.g., 10 to 25, preferably about 19 pulses per second). To assure uniform and predictable exposure of a target to electric discharges from weapon 100, it is desirable that conduction of gap 118 begin at about the same time of the cycle and continue for about the same duration in each cycle. As discussed above, when gap 118 exhibits an increased breakdown voltage, time T206 is delayed from time T204 and the magnitude of voltage of signal $V_C$ may exceed a desired design limit.

A voltage waveform represented by signal $V_P$ is sourced from weapon 100 and impressed across a pair of electrodes (e.g., a stun terminal, terminals of a projectile, or tethered probes). Typically this waveform is sufficient to interfere with voluntary control of the target's skeletal muscles, particularly the muscles of the thighs and/or calves. In another implementation, use of the hands, feet, legs and arms are included in the effected immobilization. The shape of the waveform may includes a pulse with decreasing amplitude (e.g., a trapezoid shape). The shape of the waveform may be generated from a capacitor discharge between an initial voltage and a termination voltage.

The initial voltage may be a relatively high voltage for paths through the target that include ionization at the target (e.g., from clothing to skin) to be maintained or a relatively low voltage for paths that do not include ionization. The voltage suitable for ionization at the target may be from about 3 Kvolts to about 6 Kvolts, preferably about 5 Kvolts. The voltage without ionization may be from about 100 to about 600 volts, preferably from about 350 volts to about 500 volts, most preferably about 400 volts.

The termination voltage may be determined to deliver a predetermined charge per pulse. Charge per pulse minimum may be designed to assure continuous muscle contraction as opposed to discontinuous muscle twitches. Continuous muscle contraction has been observed in human targets where charge per pulse is above about 15 microcoulombs. A minimum of about 50 microcoulombs is used in one implementation. A minimum of 85 microcoulombs is preferred, though higher energy expenditure accompanies the higher minimum charge per pulse.

Charge per pulse maximum may be determined to avoid cardiac fibrillation in the target. For human targets, fibrillation has been observed at 1355 microcoulombs per pulse and higher. The value 1355 is an average observed over a relatively wide range of pulse repetition rates (e.g., from about 5 to 50 pulses per second), over a relatively wide range of pulse durations consistent with variation in resistance of the target (e.g., from about 10 to about 1000 microseconds), and over a relatively wide range of peak voltages per pulse (e.g., from about 50 to about 1000 volts). A maximum of 500 microcoulombs significantly reduces the risk of fibrillation while a lower maximum (e.g., about 100 microcoulombs) is preferred to conserve energy expenditure.

Pulse duration (e.g., from time T206 to time T208) is preferably dictated by delivery of charge as discussed above. Pulse duration according to various aspects of the present invention is generally longer than conventional systems that use peak pulse voltages higher than the ionization potential of air. Pulse duration may be in the range from about 20 to about 500 microseconds, preferably in the range from about 30 to about 200 microseconds, and most preferably in the range from about 30 to about 100 microseconds.

By conserving energy expenditure per pulse, longer durations of immobilization may be effected and smaller, lighter power sources may be used (e.g., in a projectile comprising a battery). In one implementation, a AAAA size battery is included in a projectile to deliver about 1 watt of power during target management which may extend to about 10 minutes. In such an embodiment, a suitable range of charge per pulse may be from about 50 to about 150 microcoulombs.

Initial and termination voltages may be designed to deliver the charge per pulse in a pulse having a duration in a range from about 30 microseconds to about 210 microseconds (e.g., for about 50 to 100 microcoulombs). A discharge duration sufficient to deliver a suitable charge per pulse depends in part on resistance between electrodes at the target. For example, a one RC time constant discharge of about 100 microseconds may correspond to a high voltage capacitance of about 1.75 microfarads and a resistance of about 60 ohms. An initial voltage of 100 volts discharged to 50 volts may provide 87.5 microcoulombs from the 1.75 microfarad capacitor.

A termination voltage may be calculated to ensure delivery of a predetermined charge. For example, an initial value may be observed corresponding to the voltage across a capacitor. As the capacitor discharges delivering charge into the target, the observed value may decrease. A termination value may be calculated based on the initial value and the desired charge to be delivered per pulse. While discharging, the value may be monitored. When the termination value is observed, further discharging may be limited (or discontinued) in any conventional manner. In an alternate implementation, delivered current is integrated to provide a measure of charge delivered. The monitored measurement reaching a limit value may be used to limit (or discontinue) further delivery of charge.

Pulse durations in alternate implementations may be considerably longer than 100 microseconds, for example, up to 1000 microseconds. Longer pulse durations increase a risk of cardiac fibrillation. In one implementation, consecutive strike pulses alternate in polarity to dissipate charge which may collect in the target to adversely affect the target's heart.

Pulses may be delivered at a rate of about 5 to about 50 pulses per second, preferably about 20 pulses per second. The series of pulses may continue from the rising edge of the first pulse to the falling edge of the last pulse for from 1 to 5 seconds, preferably about 2 seconds.

A trigger event typically precedes delivery of output signal $V_P$ by weapon 100. A time between the occurrence of a trigger event (at time T204) and assertion of signal $V_K$ may be negligible (as shown). A trigger event may be detected by control circuit 102 in any conventional manner (e.g., operation of a trigger trip wire, impact sensor, or finger pull switch). Conditions determining a trigger event may persist or be repeated. As shown, conditions are detected for what is herein called a "first" trigger event (T204) that follows a period of nonconduction of gap 118 spanning a considerable period of time (e.g., more than 12 hours, preferably about 24 hours, prior to time T204) before conditions are detected. In other words, the first trigger event is the trigger event immediately preceding a "first" conduction of gap 118 (e.g., from time T206 to time T208) that follows a relatively extensive period of absence of light on gap 118. In other implementations, control circuit 102 has no knowledge of the length of time between conductions of gap 118 and consequently treats each detected event as if it were a first event following an extensive period of absence of light on gap 118.

In some implementations of weapon 100, a first trigger event as discussed above may be preceded by one or more pre-trigger events. A pre-trigger event may be detected by control circuit 102 in any conventional manner (e.g., operation of electronics that "arm" the weapon, operation of one or more mechanical, electrical, or electronic "safety" switches, chambering of an electrified projectile, mounting a probe delivery cartridge). Conditions determining a pre-trigger event may persist or be repeated. As shown, conditions are detected for a "last" pre-trigger event (at time T202) preceding a first trigger event (at time T204) as discussed above.

Figure 2:
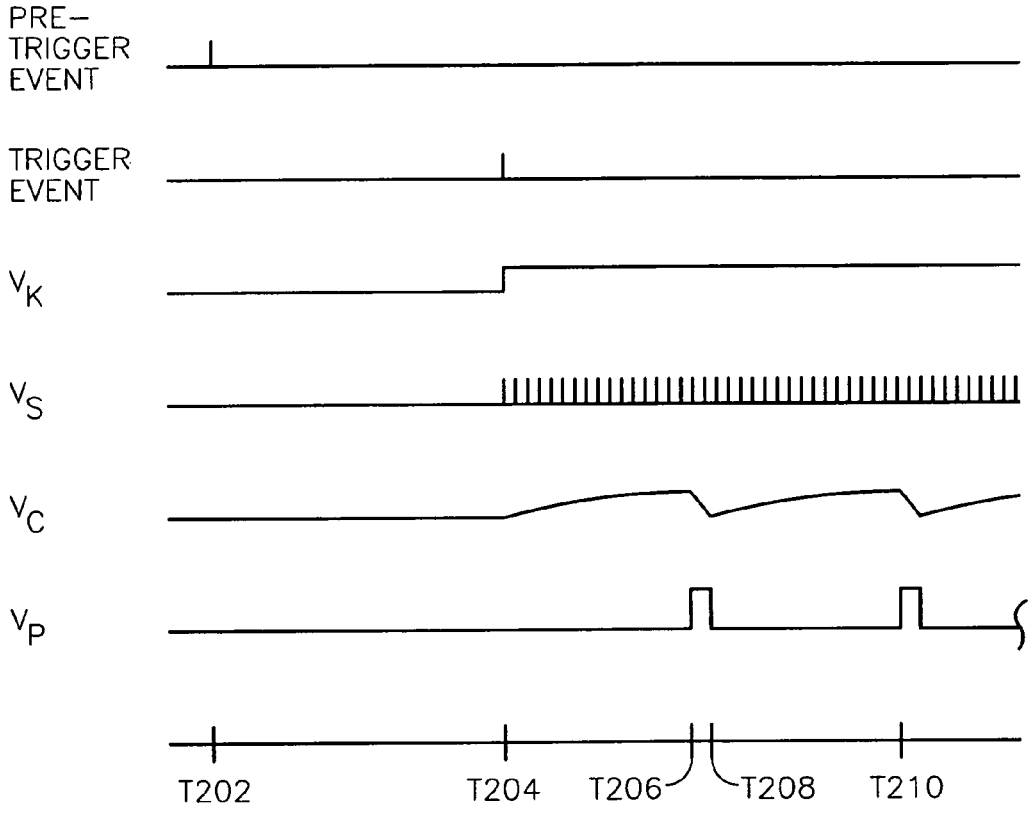
FIG. 2 is a timing diagram of signals occurring in the weapon of FIG. 1.

A person of ordinary skill will recognize where times shown in FIG. 2 are extended or compressed for clarity of presentation. The duration between times T202 and T204 is representative of any application dependent period of time. In one implementation, where the pre-trigger event at time T202 is a manual operation of a safety device (e.g., a safety mechanism; or electrical switch recognized by control circuit 102), and the trigger event at time T204 is a manual operation of a finger pull trigger switch (e.g., recognized by control circuit 102), at least 100 milliseconds transpires between a last pre-trigger event and a first trigger event. A charge duration from time T204 to time T206 may be from about 20 to about 200 milliseconds, preferably about 50 milliseconds (e.g., 19 pulses per second). A discharge duration from time T206 to time T208 may be from about 10 to about 300 microseconds, preferably from about 30 to 210, and most preferably from about 50 to about 100 microseconds.

As shown in FIG. 1, light source 116 may provide illumination substantially during the assertion of signal $V_L$ (e.g., negligible initializing and extinguishing delays of light source 116). Illumination may be of constant brightness. In other implementations, illumination is not of constant magnitude while signal $V_L$ is asserted (e.g., sinusoidal, halversine, linearly or exponentially changing). Signal $V_L$ may be based on signals $V_K$, $V_S$, and/or $V_C$, as discussed above.

Figure 3:
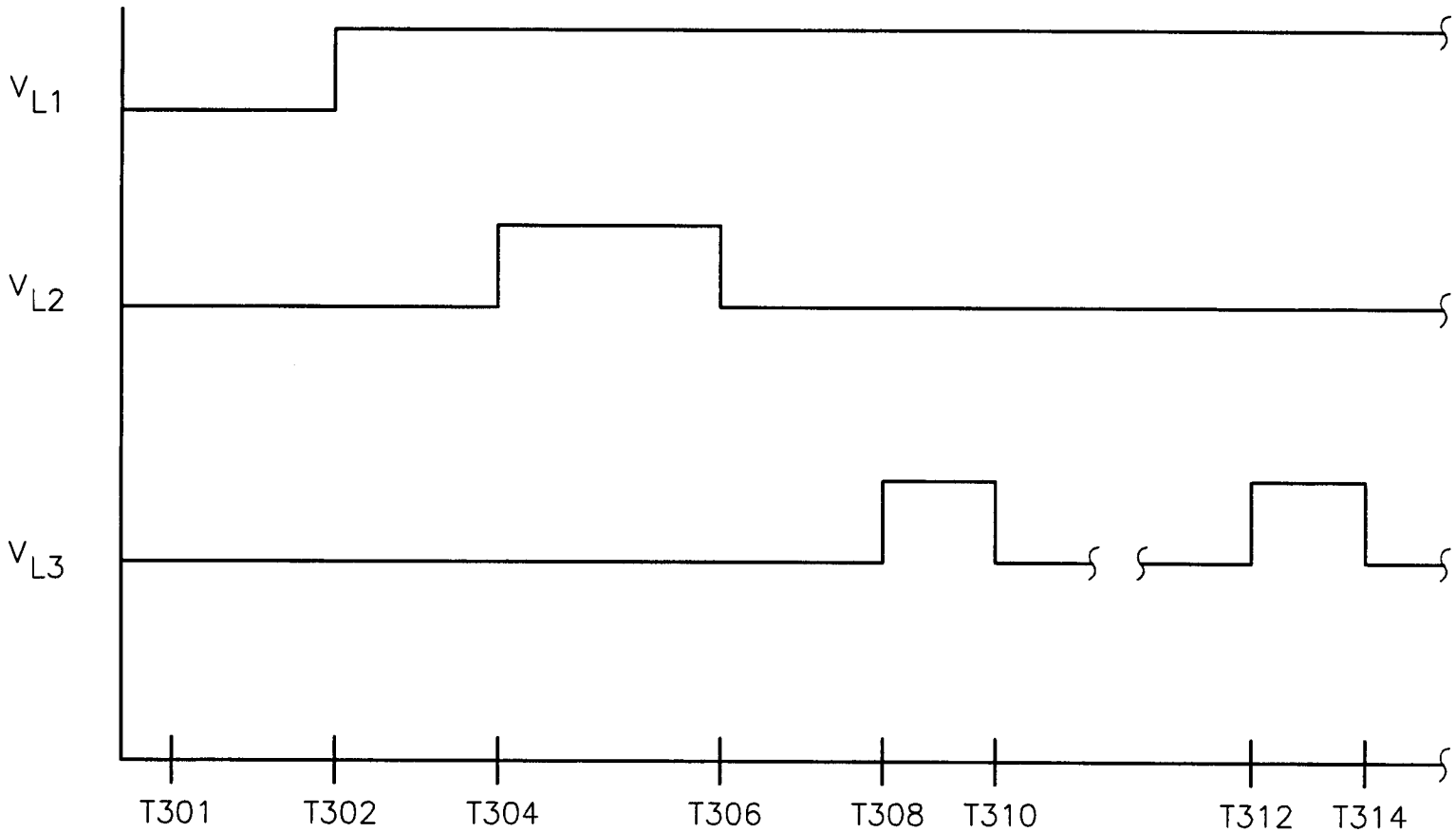
FIG. 3 is a timing diagram of alternative waveforms of a signal of the weapon of FIG. 1.

FIG. 3 illustrates three formats for signal $V_L$. The three formats have no timing relationship to each other; and references to times T301–T314 apply to each format independently. Signal $V_L$ may be provided continuously (e.g., $V_{L1}$), as a single pulse (e.g., $V_{L2}$), or as a series of pulses (e.g., $V_{L3}$ only two pulses shown), collectively referred to as signal $V_L$. A single pulse may have a duration of from about 1 millisecond to about 1 minute from time T304 to time T306). In a series of pulses, each pulse may each a duration of from about 1 microsecond to about 100 milliseconds. A repetition rate for a series of pulses may be in the range from about 1 per 24 hours to about 50 KHz. A series of pulses $V_{L3}$ may consist of a predetermined number of pulses (e.g., from about 10 to about 100) separated by a predetermined interpulse duration (e.g., in a range of from about 1 millisecond to about 1 second from time T310 to time T312). The series may be restarted as discussed below (e.g., after about 24 hours).

According to various aspects of the present invention, a spark gap is illuminated for a duration prior to conduction. In an implementation where control circuit 102 provides a signal of the type described as $V_{L1}$, the duration may begin at time T302. In an implementation where control circuit 102 provides a signal of the type described as $V_{L2}$, the duration may begin at time T304 and be completed at time T306. Time T306 may be on or before conduction (e.g., at time T206 of FIG. 2).

Conditions leading to assertion (or reassertion) of signal $V_L$ for implementations according to various aspects of the present invention are described in Table 1. Conditions leading to ceasing assertion of signal $V_L$ for implementations according to various aspects of the present invention are described in Table 2.

TABLE 1

| Start or Restart Mode | Conditions Detected For Beginning Illumination |
|---|---|
| 1 | Application of power to control circuit 102 or a timer. Waking a processor circuit from a low-power mode for any reason (e.g., motion detection) is equivalent to application of power to a control circuit. For example: (a) signal $V_{L1}$ may be provided in response to application of power at time T302; (b) signal $V_{L2}$ may be provided in response to application of power at time T304; or (c) signal $V_{L3}$ may be provided in response to application of power at time T308. |
| 2 | Application of power to control circuit 102 or a timer after extended period without power. An extended period without power may be calculated on application of power by subtracting the current date and time from a record of the date and time when power was removed, or when gap 118 last conducted. The record may be stored during a power down sequence (e.g., power held up by a discharging capacitor). The record may be stored in a nonvolatile portion of memory 103 of control circuit 102. In one implementation, an extended period of time is defined to be about 24 hours. Implementations of signal $V_L$ may be as described with reference to Start Mode 1. |
| 3 | Pre-trigger event. For example: (a) signal $V_{L1}$ may be provided in response to a pre-trigger event at time T302; (b) signal $V_{L2}$ may be provided in response to a pre-trigger event at time T304; or (c) signal $V_{L3}$ may be provided in response to a pre-trigger event at time T308. |
| 4 | Trigger event. For example: (a) signal $V_{L1}$ may be provided in response to a trigger event at time T302; (b) signal $V_{L2}$ may be provided in response to a trigger event at time T304; or (c) signal $V_{L3}$ may be provided in response to a trigger event at time T308. |
| 5 | No pre-trigger event. In one implementation, a timer is started on application of power to control circuit 102. Illumination is begun in response to time-out of the timer. The timing duration of the timer may be about 24 hours. Implementations of signal $V_L$ may be as described with reference to Start Mode 1. In one implementation, the timing duration is the interpulse duration of signal $V_{L3}$ as discussed above. |
| 6 | No trigger event. Operation is analogous to Start Mode 5. |
| 7 | No trigger event following pre-trigger event. In one implementation, a timer is started on detection of a pre-trigger event. Illumination is begun in response to time-out of the timer. The timing duration may be about 24 hours. Implementations of signal $V_L$ may be as described with reference to Start Mode 1. In one implementation, the timing duration is the interpulse duration of signal $V_{L3}$ as discussed above. |
| 8 | Periodic illumination. In one implementation, illumination and non-illumination are timed for providing periodic illumination. As in signal $V_{L3}$ illumination may be timed for a period from time T308 to time T310 (e.g., 50 milliseconds) and retriggered after lapse of an interpulse duration from time T310 to time T312 (e.g., 24 hours). In another implementation a series of pulses is provided in a burst (e.g., 10 pulses 10 milliseconds each at a rate of 100 pulses per second). Periodic illumination may include providing the burst at regular intervals. Periodic illumination (e.g., as signal $V_{L3}$ may begin in any of Start Modes 1–7). |
| 9 | Non-illumination, Illumination may be started after lapse of a period of non-illumination of greater than 12 hours. |

TABLE 2

| Stop Mode | Conditions Detected for Extinguishing Illumination |
|---|---|
| 1 | Removal of power from control circuit 102. The date and time of removal of power may be written to nonvolatile memory in a power down sequence as discussed above. |
| 2 | Completion of timed illumination. Timing may be provided by an analog timer (e.g., according to an RC time constant). Timing may be provided by a counter, alone or in combination with an analog circuit, as when a counter is clocked by a retriggerable analog timing circuit or oscillator. For example: (a) signal $V_{L2}$ may be removed in response to a time-out at time T306; or (b) signal $V_{L3}$ may be removed in response to a time-out at each time T310 and T314. |
| 3 | First conduction of gap 118. Signal $V_{L2}$ may be removed in response to a first conduction of gap 118 at time T306. The date and time of a last conduction of gap 118 (e.g., end of application of 10 second series of pulses via signal $V_P$) may be written to nonvolatile memory in a power down sequence as discussed above. |
| 4 | Completion of a series of output pulses. Signal $V_L$ may be removed in response to a falling edge (or non-assertion) of a control signal (e.g., $V_K$) coinciding generally with disabling a high voltage circuit, a last charge cycle, or the last pulse $V_P$ of a series of output pulses. |

A weapon 100 may include one or more modes of operation. Each mode may include a combination of detecting and acting on one or more conditions as discussed in Table 1 and Table 2. Control circuit 102 may include any conventional mechanism for designation (e.g., configuration or operation) from time to time of one or more modes of operation for weapon 100.

For instance, Start/Restart Modes 3 and 2 may be implemented with Stop Modes 1 and 2 as follows. An LED is placed in series with a safety switch, the battery, and a capacitor shunted to ground by a bleed resistor. The LED operates to illuminate the gap while the capacitor charges. The capacitor discharges only through the bleed resistor (e.g., a time constant of about 24 hours) if the series charging circuit is interrupted (e.g., safety switch moved back to "safety" and/or battery removed). Illumination for a full duration is not performed unless power has been removed (or safety "on") for an extended period of time sufficient for the capacitor to bleed off a full charge. This illumination is generally consistent with signal format $V_{L2}$ even though the charge (and recharge) voltage across the capacitor causes the brightness of the LED to be somewhat nonuniform while on.

For a battery powered, hand held gun of the type that launches tethered probes to a target, Start Mode 3 and Stop Mode 2 is desirable for simplicity of control circuitry (e.g., illumination follows safety switch operation without complex control circuitry 102). Use of Start Mode 4 and Stop Mode 4 is desirable for lower battery power consumption (e.g., illumination follows signal $V_K$). Where conservation of battery power is a priority (e.g., a relatively long life hand held gun or a land mine), Start Mode 4 and Stop Mode 3 are preferred.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A weapon for conducting a current through a target to stun or immobilize the target, the weapon comprising:

a circuit comprising:

a spark gap having a breakdown voltage for conduction, the current being produced in response to conduction by the spark gap; and a capacitance having a voltage across the capacitance that in operation increases until conduction by the spark gap occurs, whereby conduction by the spark gap occurs in response to reaching a magnitude of the voltage across the capacitance;

a white light source that illuminates the spark gap for a duration of illumination that begins substantially prior to conduction by the spark gap to avoid increasing the voltage across the capacitance beyond a limit of operation of the circuit.

2. The weapon of claim 1 wherein the spark gap comprises an electrode and a gas, at least a portion of the gas being illuminated by the light source.

3. The weapon of claim 1 wherein the light source begins illuminating the spark gap in response to a pre-trigger event.

4. The weapon of claim 3 wherein the pre-trigger event comprises an operation of a safety switch enabling triggering of the weapon.

5. The weapon of claim 4 wherein illumination continues until a second operation of the safety switch disabling triggering of the weapon.

6. The weapon of claim 1 further comprising a control circuit wherein the light source begins illuminating the spark gap in response to a signal provided by the control circuit and the control circuit asserts the signal on lapse of a second duration greater than 12 hours.

7. The weapon of claim 1 further comprising a control circuit wherein the light source begins illuminating the spark gap in response to a signal provided by the control circuit and the control circuit asserts the signal in response to detecting a trigger event.

8. The weapon of claim 7 wherein the trigger event comprises operation of a trigger switch.

9. The weapon of claim 7 wherein the the current comprises a plurality of pulses through the target and illumination continues during the plurality of pulses.

10. The weapon of claim 1 further comprising a control circuit wherein the light source begins illuminating the spark gap in response to a signal provided by the control circuit.

11. The weapon of claim 10 wherein illumination continues until conduction by the spark gap.

12. An electrified projectile comprising the weapon of claim 1.

13. A hand held stun device comprising the weapon of claim 1.

14. A land mine comprising the weapon of claim 1.

15. A weapon of claim 1 capable of receiving a wire tethered probe for launching the probe toward the target to conduct the current through the target.

16. The weapon of claim 15 wherein the weapon is hand held.

17. A device for stationary installation comprising the weapon of claim 15.

18. A method performed by a weapon comprising a probe for launching toward a target or a terminal held against a target, a capacitance, a white light source, and a spark gap, the method comprising:

illuminating the spark gap from the white light source;

after illuminating has begun, increasing a voltage across the capacitance to a magnitude at which conduction by the spark gap occurs; and while conduction occurs, providing a current through the probe or terminal and through the target, the current to stun or immobilize the target.

19. The method of claim 18 further comprises detecting a pre-trigger event before illuminating.

20. The method of claim 19 wherein the pre-trigger event comprises an operation of a safety switch of the weapon that enables triggering of the weapon.

21. The method of claim 20 wherein illuminating continues until a second operation of the safety switch that disables triggering of the weapon.

22. The method of claim 18 wherein:

the method further comprises:

discontinuing illuminating at a first time; and determining a duration of non-illumination from the first time; and illuminating begins if the duration is greater than 12 hours.

23. The method of claim 18 wherein illuminating begins after a trigger event.

24. The method of claim 23 wherein the trigger event comprises operation of a trigger switch of the weapon.

25. The method of claim 18 wherein illuminating continues until an end of a series of electric discharges provided by the weapon, the series being less than about 10 seconds.

26. The method of claim 18 wherein illuminating continues until conduction by the spark gap.

27. A computer programmed product comprising code for performing the method of claim 18.

* * * * *

UNITED STATES PATENT AND TRADEMARK OFFICE

CERTIFICATE OF CORRECTION

PATENT NO. : 7,336,472 B2
APPLICATION NO. : 10/957315
DATED : February 26, 2008
INVENTOR(S) : Magne H. Nerheim et al.

It is certified that error appears in the above-identified patent and that said Letters Patent is hereby corrected as shown below:

In column 4, line 28, after "of" insert -- pulse transformer 120 until conduction by gap 118 ceases (at time (T208). Illumination may be --.

In column 10, line 59, in Claim 9, delete "the the" and insert -- the --, therefor.

Signed and Sealed this
Fourth Day of October, 2011

David J. Kappos

David J. Kappos
*Director of the United States Patent and Trademark Office*